US010240245B2

(12) United States Patent
Piascik et al.

(10) Patent No.: US 10,240,245 B2
(45) Date of Patent: Mar. 26, 2019

(54) SYSTEMS, METHODS, AND ANODES FOR ENHANCED IONIC LIQUID BATH PLATING OF TURBOMACHINE COMPONENTS AND OTHER WORKPIECES

(71) Applicant: HONEYWELL INTERNATIONAL INC., Morris Plains, NJ (US)

(72) Inventors: James Piascik, Phoenix, AZ (US); Vincent Chung, Tempe, AZ (US); Lee Poandl, Middlesex, NJ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 57 days.

(21) Appl. No.: 15/635,833

(22) Filed: Jun. 28, 2017

(65) Prior Publication Data

US 2019/0003070 A1 Jan. 3, 2019

(51) Int. Cl.
*C25D 21/04* (2006.01)
*C25D 21/18* (2006.01)
(Continued)

(52) U.S. Cl.
CPC ..... *C25D 7/00* (2013.01); *C25D 3/56* (2013.01); *C25D 3/665* (2013.01); *C25D 5/003* (2013.01);
(Continued)

(58) Field of Classification Search
CPC ..... C25D 21/04; C25D 5/003; C25D 3/665
See application file for complete search history.

(56) References Cited

U.S. PATENT DOCUMENTS 4,066,515 A * 1/1978 Stoger ..... C25D 3/44 204/213
5,312,532 A 5/1994 Andricacos et al.
(Continued)

FOREIGN PATENT DOCUMENTS

DE 2944401 A1 5/1981
EP 2966190 A1 1/2016
EP 3103895 A1 12/2016

OTHER PUBLICATIONS

Ritzdorf, T., Modern Electroplating, Fifth Edition—Monitoring and Control; Dec. 31, 2010.
(Continued)

*Primary Examiner* — Brian W Cohen
(74) *Attorney, Agent, or Firm* — Lorenz & Kopf, LLP

(57) ABSTRACT

Ionic liquid bath plating systems, methods, and plating anodes are provided for depositing metallic layers over turbomachine components and other workpieces. In an embodiment, the method includes placing workpieces in a plurality of cell vessels such that the workpieces are at least partially submerged in plating solution baths, which are retained within the cell vessels when the plating system is filled with a selected non-aqueous plating solution. After plating anodes are positioned adjacent the workpieces in the plating solution baths, the plurality of cell vessels are enclosed with lids such that the plurality of cell vessels contain vessel headspaces above the plating solution baths. A first purge gas is then injected into the plurality of cell vessels to purge the vessel headspaces. The workpieces and the plating anodes are then energized to deposit metallic layers on selected surfaces of the workpieces utilizing an ionic liquid bath plating process.

18 Claims, 4 Drawing Sheets

(51) Int. Cl.

| | |
|---|---|
| ***C25D 3/66*** | (2006.01) |
| ***C25D 7/00*** | (2006.01) |
| ***C25D 3/56*** | (2006.01) |
| ***C25D 5/00*** | (2006.01) |
| *F01D 5/28* | (2006.01) |
| *F04D 29/32* | (2006.01) |
| *F01D 9/02* | (2006.01) |

(52) U.S. Cl.
CPC ..... *C25D 21/04* (2013.01); *C25D 21/18* (2013.01); *F01D 5/288* (2013.01); *F01D 9/02* (2013.01); *F04D 29/324* (2013.01); *F05D 2220/32* (2013.01); *F05D 2230/30* (2013.01)

(56) References Cited

U.S. PATENT DOCUMENTS

| | | | | |
|---|---|---|---|---|
| 5,415,890 | A | 5/1995 | Kloiber et al. | |
| 6,557,237 | B1 | 5/2003 | Olgado | |
| 7,879,206 | B2 | 2/2011 | Matthews | |
| 8,778,164 | B2 | 7/2014 | Piascik et al. | |
| 2009/0065363 | A1* | 3/2009 | Liakopoulos | C25D 3/562 205/89 |
| 2009/0134039 | A1 | 5/2009 | Matthews | |
| 2012/0024696 | A1 | 2/2012 | Tomantschger | |
| 2012/0231574 | A1 | 9/2012 | Wang | |
| 2012/0292191 | A1 | 11/2012 | Goto et al. | |
| 2013/0327648 | A1 | 12/2013 | Grant et al. | |
| 2013/0341197 | A1* | 12/2013 | Piascik | C25D 5/12 205/176 |
| 2014/0166476 | A1 | 6/2014 | Abraham et al. | |
| 2015/0041327 | A1 | 2/2015 | Buckalew et al. | |
| 2015/0101935 | A1 | 4/2015 | Chen | |

OTHER PUBLICATIONS

Extended EP Search Report for Application No. 18178913.2 dated Nov. 30, 2018.

* cited by examiner

SYSTEMS, METHODS, AND ANODES FOR ENHANCED IONIC LIQUID BATH PLATING OF TURBOMACHINE COMPONENTS AND OTHER WORKPIECES

TECHNICAL FIELD

The present disclosure relates generally to electroplating processes and, more particularly, to ionic liquid bath plating systems, methods, and anodes for depositing metallic layers over metallic workpieces, such as turbomachine components having relatively complex surface geometries.

ABBREVIATIONS

APS—Atmospheric Plasma Spray;
CVD—Chemical Vapor Deposition;
EBC—Environmental Barrier Coating;
GTE—Gas Turbine Engine;
MCrAlY—a material containing chromium, aluminum, yttrium, and "M" as its primary constituents by weight, wherein "M" is nickel, cobalt, or a combination thereof;
TBC—Thermal Barrier Coating;
USD—United States Dollars; and
Vol %—Volume percentage.

BACKGROUND

Specialized coatings are commonly formed over rotor blades, nozzle vanes, combustor parts, and other turbomachine components for protection from rapid degradation within the chemically harsh, high temperature turbomachine environment. The production of such high temperature coatings often entails the deposition of one or more metallic layers over component surfaces having relatively complex geometries, such as the aerodynamically-streamlined pressure and suction sides of a rotor blade or nozzle vane. Traditionally, CVD, pack cementation, APS, and similar processes have been employed to deposit the metallic layers utilized to produce such high temperature coatings. More recently, however, ionic liquid bath plating processes have emerged as a viable alternative to such conventional deposition processes. Advantageously, ionic liquid bath plating processes are well-suited for depositing metallic layers, including aluminum-containing metallic layers utilized in the production of MCrAlY bond coats, aluminide coatings, and platinum-aluminide, over metallic components having relatively complex geometries. Additionally, ionic liquid bath plating processes can be performed at relatively low processing temperatures to mitigate high temperature masking requirements often associated with conventional deposition processes.

While providing the above-noted advantages, ionic liquid bath plating processes remain limited in several respects. Ionic liquid bath plating solutions are often costly, and, in certain cases, may cost in excess of 100,000 USD when obtained in sufficient volume to fill a conventional large capacity (e.g., 100 gallon) plating solution bath. Such plating solutions are typically non-aqueous and highly sensitive to water contamination, with plating performance degradation potentially occurring with exposure to moisture contained in the ambient air. The throwing power and electrical conductivity within the ionic liquid plating solution bath is often relatively poor. As a result, it may be desirable or necessary to position the turbomachine components (or other workpieces) to be plated immediately adjacent the plating anodes in a highly precise, non-contacting relationship. Finally, as a still further limitation, the plating anodes utilized in ionic liquid bath plating must typically remain within the plating solution bath after anode activation. Thus, when multiple anodes are utilized to plate multiple workpieces in parallel utilizing an open bath plating setup, replacement or reinsertion of individual plating anodes may necessitate shutdown of the entire plating system shutdown adding undesired cost and delay to the plating process.

There thus exists an ongoing need for improved ionic liquid bath plating systems and methods, which overcome one or more of the limitations set-forth above. Ideally, such ionic liquid bath plating systems and methods would be well-suited for usage in depositing metallic (e.g., aluminum-containing) layers onto the contoured surface of turbomachine components including, for example, rotor blades, nozzle vanes, and turbomachine components containing multiple airfoils at the time of plating, such as bladed GTE rotors and turbine nozzles. Similarly, it would be desirable to provide anodes facilitating the deposition of metallic layers onto airfoil-containing turbomachine components utilizing such ionic liquid bath plating processes. Other desirable features and characteristics of embodiments of the present invention will become apparent from the subsequent Detailed Description and the appended Claims, taken in conjunction with the accompanying drawings and the foregoing Background.

BRIEF SUMMARY

Ionic liquid bath plating systems for depositing metallic layers over workpieces, such as turbomachine components having relatively complex surface geometries, are provided. In various embodiments, the ionic liquid bath plating system includes a gas-purged plating cell array containing multiple cell vessels. Each cell vessel holds a plating solution bath when the ionic liquid bath plating system is filled with a selected non-aqueous plating solution. Movable covers or lids can be positioned over the open upper ends of the cell vessels to sealingly enclose the vessel interiors during the plating process. When the cell vessels are enclosed, gas-filled regions (herein, "vessel headspaces") are provided within the cell vessels above the plating solution baths. A vessel purge subsystem is fluidly coupled to cell vessels and, specifically, to the vessel headspaces. The vessel purge subsystem is configured to selectively direct a first purge gas into the vessel headspaces to expel moisture-containing air from the vessel headspaces and, in so doing, prevent or at least minimize moisture contamination of the plating solution baths. In certain implementations, the ionic liquid bath plating system further includes a gas-purged reservoir tank and a flow circuit. The gas-purged reservoir tank holds a plating solution reservoir, which usefully has a volume greater than any one of the plating solution baths retrained or held within the cell vessels. The flow circuit fluidly couples the gas-purged reservoir tank to the cell vessels to enable circulation of the non-aqueous plating solution between the plating solution baths and the reservoir during plating system operation.

Embodiments of an ionic liquid bath plating method are further provided. In various embodiments, the ionic liquid bath plating method includes the steps or processes of placing a plurality of workpieces in separate cell vessels, which are contained in a gas-purged plating cell array. Consumable plating anodes are further positioned adjacent the workpieces within the cell vessels. Before or after placement of the workpieces and positioning of the plating anodes, the cell vessels are partially filled with plating solution baths in which the workpieces and plating anodes are submerged, in whole or in part. The cell vessels are then sealingly enclosed such that sealed, gas-filled vessel headspaces are created above the plating solution baths. A first purge gas is directed into the vessel headspaces to expel any moisture-containing air trapped within the enclosed cell vessels. Ionic liquid bath plating is subsequently carried-out by applying an electrical potential across the plating anodes and workpieces sufficient to deposit metallic layers over non-masked surfaces of the workpieces. The metallic layers may be composed of material contributed by the plating anodes, when consumable, and/or by material deposited or co-deposited from the plating solution baths. In at least some implementations, non-aqueous plating solution may be actively circulated between the plating solution baths and a larger volume plating solution reservoir, which is retained or held in a gas-purged reservoir tank, during the plating process.

Embodiments of the ionic liquid bath plating method may be particularly useful in depositing metallic layers over selected surfaces of turbomachine components, such as the blades of bladed GTE rotor (e.g., a compressor or turbine wheel) or the vanes of a turbine nozzle. When utilized for this purpose, the ionic liquid bath plating method may entail the step or process of positioning a multi-airfoil plating anode (that is, a plating anode utilized to concurrently plate multiple airfoils) adjacent a turbomachine component containing multiple airfoils, such as an annular array of blades or vanes. The multi-airfoil plating anode may be positioned such that anode fingers, which project from the body of the plating anode, are received between the airfoils of the turbomachine component in a close proximity, non-contacting relationship. During or after positioning, the multi-airfoil plating anode and the turbomachine component are at least partially submerged in a plating solution bath. An electrical potential is then applied between the plating anode and the turbomachine component to deposit metallic layers over the airfoils and, perhaps, other non-masked regions of the turbomachine component. In embodiments in which the airfoils and anode fingers twist about the centerlines of the turbomachine component and plating anode, respectively, the multi-airfoil plating anode may be positioned adjacent the turbomachine component by relative linear movement along an insertion axis coaxial with the component and plating anode centerlines, while relative rotational movement or a twisting action about the insertion axis is applied to avoid contact between the anode fingers and the airfoils during the position process.

Various additional examples, aspects, and other useful features of embodiments of the present disclosure will also become apparent to one of ordinary skill in the relevant industry given the additional description provided below.

BRIEF DESCRIPTION OF THE DRAWINGS

At least one example of the present invention will hereinafter be described in conjunction with the following figures, wherein like numerals denote like elements, and.

DETAILED DESCRIPTION

Figure 1:
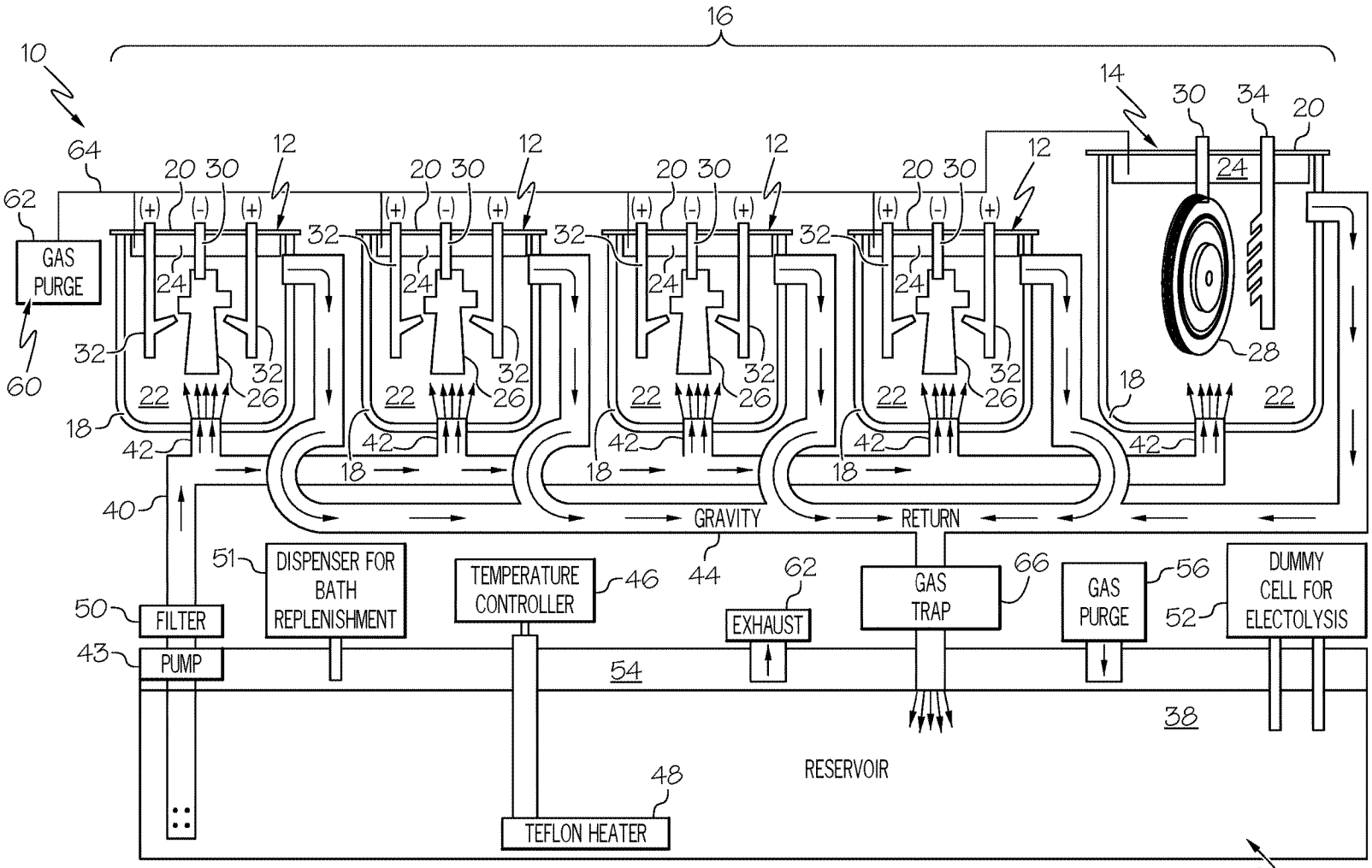
FIG. 1 is a schematic of an ionic liquid bath plating system including a gas-purged plating cell array, as illustrated in accordance with an exemplary embodiment of the present disclosure.

The following Detailed Description is merely exemplary in nature and is not intended to limit the invention or the application and uses of the invention. Furthermore, there is no intention to be bound by any theory presented in the preceding Background or the following Detailed Description. The term "exemplary," as appearing throughout this document, is synonymous with the term "example" and is utilized repeatedly below to emphasize that the following description provides only multiple non-limiting examples of the invention and should not be construed to restrict the scope of the invention, as set-out in the Claims, in any respect. As further appearing herein, the term "metallic layer" refers to a layer composed predominately of metallic constituents by weight percent.

Overview

Ionic liquid bath plating systems and methods are provided, as are multi-airfoil plating anodes adapted for concurrently plating multi-airfoil turbomachine components. The below-described ionic liquid bath plating systems and methods may be particularly useful in plating metallic workpieces having relatively complex surface geometries. In such cases, the results of the plating process may be optimized by precisely positioning the plating anodes with respect to the non-masked workpiece surfaces targeted for plating. In various embodiments, the ionic liquid bath plating system facilitates such precise, close-proximity positioning of the plating anodes relative to the workpiece surfaces by foregoing the conventional large open bath plating setup in favor of a compartmentalized or multicell plating solution bath architecture. In this regard, the ionic liquid bath plating system is usefully equipped with a plating cell array, which contains multiple individual plating cells each holding a reduced volume plating cell bath; the term "reduced volume" utilized in a relative sense as compared to conventional large capacity (e.g., 100 gallon) open bath setup, and the term "plating cell array" referring to any grouping or spatial distribution of at least two plating cells included in a plating system of the type described herein. Manual access to the plating cells is eased, facilitating precise positioning of the plating anodes and workpieces. Additionally, the cumulative volume of plating solution required for plating system operation is reduced to lower material costs. As a further advantage, the multicell design of the plating cell array enables the replacement or reinsertion of individual anodes without necessitating plating system shutdown. Plating system throughput is thus boosted, while operational costs are reduced.

The ionic liquid bath plating systems described herein provide other notable advantages, as well. The plating cell array can be more thoroughly sealed from the ambient environment due, at least in part, to a reduced cumulative volume (and therefore reduced cumulative surface area) of the plating solution baths relative to a conventional, large capacity open bath setup. This, in turn, helps avoid or at least minimize contact between the non-aqueous plating solutions and moisture contained within the ambient environment. Additionally, the ionic liquid bath plating system may further include a gas purge subsystem, which selectively directs a purge gas into the vessel headspaces (that is, the gas-filled region of the cell vessels above the plating solution baths) to expel any moisture-containing air trapped within the cell vessels when enclosed. Such purge gas may be supplied in an ultradry state containing less than 0.1% moisture, by volume. In certain embodiments, the purge gas may be supplied as a cooled argon-based gas or a similar, relatively heavy gas (e.g., a nitrogen-based gas), which tends to form a blanket by settling over the plating solution baths. In this manner, the gaseous blanket may further reduce contact between ambient air and the plating solution baths when the cell vessels are opened, while still permitting workpieces and anodes to be inserted into and removed from the baths, as needed. By virtue of such a design, moisture contamination of the non-aqueous plating solution can be minimized to further optimize plating performance.

Embodiments of the ionic liquid bath plating system further include a gas-purged reservoir tank and a flow circuit. When the ionic liquid bath plating system is filled with a selected non-aqueous plating solution, the flow circuit may permit active circulation or exchange of the plating solution between the plating solution baths and a large volume plating solution reservoir contained in the gas-purged reservoir tank. In this manner, fresh plating solution may be continually supplied to the cell vessels during the plating process and, perhaps, injected as jet flow impinging upon regions of the workpiece targeted for plating. The non-aqueous plating solution contained in the plating solution reservoir can be conditioned by filtering, temperature control, electrolytic pre-conditioning, and the like. If desired, the components or devices utilized for conditioning the plating solution can be remotely located from the plating cell array to further provide unobstructed manual access to the plating cells. Further, in implementations in which the reservoir tank contains a tank headspace, the tank headspace may be purged with a second purge gas, which may be identical in composition or which may vary in composition relative to the first purge gas utilized to purge the vessel headspaces.

The above-described ionic liquid bath plating system is usefully, although not essentially designed to impart the gas-purged plating cell array with a high degree of modularity. In this regard, embodiments of the plating system may be equipped with appropriate plumbing and valving to enable new plating cell vessels to be added to, removed from, or interchanged within other plating cell vessels within the gas-purged plating cell array on an as-needed basis. Such plumbing and valving may be integrated into both the vessel purge subsystem and the plating solution flow circuit fluidly coupling the reservoir tank to the plating cell array. When the plating system is imparted with such a modular design, new cell vessels having dimensions tailored to particular part types or designs can be added or interchanged for existing cell vessels to rapidly adapt the plating system for plating of new part types, as desired. Furthermore, plating cell size and shape can be tailored to enable the introduction of new plating cells into the plating cell array with a relatively modest increase in the cumulative volume of plating solution required for plating system operation, again minimizing material costs.

Embodiments of the ionic liquid bath plating system are well-suited for usage in the deposition of metallic layers over selected surfaces of turbomachine components. Such components often possess relatively complex, aerodynamically-streamlined surfaces, which are beneficially coated with metallic layers during the formation of high temperature coatings or multilayer coating systems. As a specific, albeit non-limiting example, it may be desirable to plate metallic layers over airfoils (blades or vanes) contained in a turbomachine component. Although the composition of such metallic layers may vary amongst embodiments, the plated metallic layers will often contain aluminum as a primary constituent, as may be the case when the metallic layers are utilized to form aluminide coatings, platinum-aluminide coatings, or MCrAlY bond coats over the airfoil surfaces. In certain cases, the ionic liquid bath plating may enable multiple discrete bladed pieces to be plated in parallel in separate cell vessels. In such implementations, the cell vessel may each be dimensioned to receive a single bladed piece (or perhaps a small number of bladed pieces), and the gas-purged plating cell array may contain a sufficient number of substantially identical cell vessels to concurrently plate several, if not all of the bladed pieces included in an insert-blade type GTE rotor. In an alternative approach, multiple airfoils contained in a turbomachine component (e.g., a bladed rotor or turbine nozzle) may be plated concurrently or simultaneously, while attached to or integrally joined to the component. Such a multi-airfoil plating operating may be facilitated through the usage of one or more uniquely-shaped, multi-airfoil plating anodes, as described more fully below conjunction with FIGS. 3-6. First, however, a generalized example of the ionic liquid bath plating system is described below in conjunction with FIG. 1.

Non-Limiting Example of Ionic Liquid Bath Plating System

FIG. 1 is a schematic of an ionic liquid bath plating system 10, as illustrated in accordance with an exemplary embodiment of the present disclosure. Ionic liquid bath plating system 10 includes a number of compartmentalized tanks or plating cells 12, 14. Plating cells 12, 14 are purged by a common purging subsystem 60 and thus collectively form a gas-purged plating cell array 16. Gas-purged plating cell array 16 may contain any practical number and type of plating cells 12, 14. The plating cells contained with array 16 can be arranged in various spatial layouts depending upon the relative dimensions of cells 12, 14, the number of cells included in plating cell array 16, and other such factors. For example, plating cells 12, 14 shown in FIG. 1 may constitute a singe row of the total plating cells contained within gas-purged plating cell array 16, which may further contain additional rows of plating cells similar or identical to plating cells 12, 14. In other implementations, the number, type, and spatial distribution of the plating cells contained within plating cell array 16 can differ. Moreover, ionic liquid bath plating system 10 may have a modular design in further embodiments, which enables plating cells to be added to and removed from gas-purged plating cell array 16, as appropriate, to best suit the requirements of a particular plating operation.

Plating cells 12, 14 contained within plating cell array 16 each include a cell vessel 18. The interiors of cell vessels 18 may be accessed through upper vessel openings. Movable covers or lids 20 can be matingly positionable over the upper vessel openings to sealingly enclose the respective interiors of cell vessels 18 during the plating process, as generally indicated in FIG. 1. Lids 20 can be freely removable from cell vessels 18 or may be attached thereto utilizing, for example, hinge couplings. Non-illustrated gaskets may be provided for enhanced sealing. The interior surfaces of cell vessels 18 and the undersides of lids 20 define plating chambers 22, 24 within cell vessels 18 when cell vessels 18 are enclosed by lids 20. When plating system 10 is filled with a selected non-aqueous plating solution, each plating chamber 22, 24 contains a fraction of the plating solution in the form of a plating solution bath 22. A gas-filled region or "vessel headspace" 24 is further provided above each plating solution bath 22 within plating chambers 22, 24 when cell vessels 18 are enclosed.

The respective dimensions of plating cells 12, 14 are usefully tailored to accommodate a particular type of workpiece, while minimize the volume within each cell 12, 14 required for filling with the non-aqueous plating solution. In the illustrated portion of plating system 10 shown in FIG. 1, two different sizes of plating cells are presented: a first, smaller plating cell type (cells 12) and a second, larger plating cell type (cell 14). Plating cells 12 are each dimensioned to accommodate a first type of metallic workpiece 26 along with corresponding plating anodes 32 utilized during the ionic liquid bath plating process, as described more fully below. In contrast, larger plating cell 14 is dimensioned to contain a second type of metallic workpiece 28 and one or more corresponding plating anodes 34. By way of non-limiting example, workpieces 26 are illustrated as insert-type rotor blade pieces in diagram of FIG. 1, while workpiece 28 is illustrated as a bladed GTE rotor. In other embodiments, plating cells 12, 14 can be shaped and dimensioned to accept different types of workpieces and/or one or more of plating cells 12, 14 can be sized to accommodate multiple workpieces within a single plating cell chamber. Specialized, electrically-conductive fixtures or cathode brackets 30 are utilized to maintain workpieces 26, 28 in their desired positions within plating cells 12, 14. Cathode brackets 30 may be affixed to lids 20 (as shown) or, instead, to an upper sidewall portion of cell vessels 18. Suitable electrical couplings or terminals are also provided for cathode brackets 30 and plating anodes 32, 34, as symbolically denoted in FIG. 1.

Ionic liquid bath plating system 10 further includes at least one reservoir tank 36. Reservoir tank 36 is usefully, although not essentially gas purged and is thus referred to as "gas purged reservoir tank 36" hereafter. When plating system 10 is filled with the selected plating solution, reservoir tank 36 retains a relatively large body of plating solution (herein, "plating solution reservoir 38"). Gas-purged reservoir tank 36 is fluidly coupled to each of plating cells 12, 14 by a plumbing network or flow circuit. As schematically indicated in FIG. 1, the flow circuit may include a supply line 40, which draws plating solution reservoir 38 from gas-purged reservoir tank 36 under the influence of one or more pumps 43. Supply line 40 supplies the plating solution to each plating cell 12, 14 through at least one injection port 42. Injection ports 42 may be positioned to inject fresh plating solution toward the surfaces of workpieces 26, 28 targeted for plating. Injection ports 42 may further be designed to create a controlled level of agitation, which aids in the plating process.

Although only a single injection portion 42 is shown for each plating cell 12, 14 in the illustrated example, multiple injection ports may be provided and strategically positioned around workpieces 26, 28 in further embodiments. This may be particularly usefully when the surface areas targeted for plating are relatively expansive and/or have relatively complex, non-planar surface geometries or topologies. During operation of plating system 10, a certain amount of plating solution may also be drawn-off each plating cell 12, 14 by, for example, spill-over into a return flow passage 44. Return flow passage 44 may then return the excess plating solution to gas-purged reservoir tank 36 (e.g., by gravity flow or under the influence of an additional, non-illustrated pump) to complete the flow circuit.

Gas-purged reservoir tank 36 may include various components for conditioning plating solution reservoir 38 to better preserve the quality and performance of the non-aqueous plating solution circulated through ionic liquid bath plating system 10. For example, as schematically indicated in the lower half of FIG. 1, gas-purged reservoir tank 36 be equipped with a temperature regulation system 46, 48 including a temperature controller 46 and (e.g. Teflon) heater 48. Various filters 50 may also be provided, as desired. Ionic liquid bath plating system 10 may be further equipped with at least one electrolytic dummy cell 52 having elongated terminals, which extend into plating solution reservoir to contact the non-aqueous plating solution retained within tank 36 as reservoir 38. When the terminals of cell 52 are energized, electrolytic dummy cell 52 drives additional electrolytic conditioning of the non-aqueous plating solution. As still further indicated in the schematic of FIG. 1, gas-purged reservoir tank 36 may also include a dispenser port 51 for the introduction of additional ionic liquid bath solution. When filled with the selected plating solution, gas-purged reservoir tank 36 further contains a tank headspace 54, which is located above plating solution reservoir 38. Vessel headspace 54 is usefully purged with a purge gas provided from a purge gas source 56, while an exhaust vent 58 fluidly connected to reservoir tank 36 may allow the outflow of the selected purge gas from vessel headspace 54, as needed.

Plating cells 12, 14 and, specifically, vessel headspaces 24 are further purged utilizing a vessel purge subsystem 60. Vessel purge subsystem 60 contains at least one gas source 62, which is fluidly coupled to each of plating cells 12, 14 via a number of conduits 64. In the illustrated example, conduits 64 inject the purge gas through lids 20; however, in further embodiments, conduits 64 may extend into or through upper portions of the sidewalls of vessels 18 to inject purge gas into vessel headspaces 24 as needed. To further reduce moisture exposure of the plating gas solution, the gas supplied by gas source 62 is beneficially provided in an ultradry state; that is, in a state containing less than 0.1% moisture, by vol %. The purge gas may be selected as an inert gas other than air. Nitrogen-based gases and argon-based gasses are two candidate gasses well-suited for this purpose; the term "nitrogen-based gas" referring to a gas consisting essentially of nitrogen or containing nitrogen as its primary constituent by vol %, while the term "argon-based gas" similarly referring to a gas consisting essentially of argon or containing argon as its primary constituent by vol %.

In one approach, vessel headspaces 24 are purged with an argon-based gas, while tank headspace 54 is purged with a nitrogen-based gas. The usage of a nitrogen-based gas to purge tank headspace 54 may help reduce cost, while the usage of argon-based gas to purge vessel headspaces 24 may provide enhanced sealing of plating solution baths 22. In this latter regard, argon-based gasses are typically heavy, in a relative sense, and thus tend to settle and form blankets of gas over plating solution baths 22. This effect may be enhanced by cooling the argon-based gasses. Such cooled argon blankets may help prevent contact with moisture-laden air when plating cells 12, 14 are opened, while allowing the insertion and removal of new workpieces and plating anodes. This notwithstanding, vessel headspaces 24 and tank headspace 54 may be purged with various other gas compositions in further embodiments, which may or may not be cooled. In embodiments in which headspaces 24, 54 are purged with different gas compositions, a gas trap 66 may be provided in return line 44 to prevent undesired gas mixing and/or the undesired displacement of a lighter gas (nitrogen) with a heavier gas (argon) within reservoir tank 36.

Ionic liquid bath plating system 10 provides a number of advantages over large capacity open bath plating setups of the type conventionally utilized within ionic liquid bath plating systems. As previously stated, the gas-purged, compartmentalized design of plating cell array 16 minimizes or prevents moisture contamination of the non-aqueous plating solutions, while facilitating manual access to process chambers 22 and precise positioning of anodes 32, 34 relative to workpieces 26, 28. Consequently, the cumulative volume of plating solution may be reduced as compared to a comparable open bath plating systems to lower overall plating solution costs. At the same time, the compartmentalized nature of gas-purged plating cell array 16 lends well to modular system designs, which afford increased flexibility in the addition, removal of, and interchange of plating cells within plating cell array 16. As a further advantage, plating cell array 16 enables anodes to remain active in a small amount of plating solution, while other anodes are removed and re-inserted to minimize system down-time, improve process efficiency, and reduce operational costs. Many of the aforementioned benefits are optimized when each individual cell vessel 18 is dimensioned and shaped to accommodate a particular type of workpiece, one or more corresponding plating anodes, and a plating solution bath having a size limited to that necessary, a size or only slightly larger than that necessary, to wholly or partially submerge the workpiece and plating anodes in the plating solution bath. In this manner, cell vessel geometry and dimensions can be varied in accordance with workpiece geometry, dimension, and workpiece orientation, as appropriate. Additionally, specialized plating anodes, which are at least partially conformal to surfaces of the workpieces targeted for plating, may be utilized to further enhance the plating process. Examples of such plating anodes will now be described in conjunction with FIGS. 2-6.

Examples of Plating Anodes Including Multi-Airfoil Plating Anodes

Embodiments of the ionic liquid bath plating system are well-suited for usage in the deposition of metallic layers over selected surfaces of turbomachine components. Such component surfaces are commonly characterized by relatively complex, aerodynamically-streamlined surface geometries or topologies, which are beneficially coated with metallic layers during the formation of high temperature coatings or multilayer coating systems. Thus, in fabricating such turbomachine components, it is often desirable to plate metallic (e.g., aluminum-containing) layers over selected surfaces of the turbomachine components for usage in forming aluminide coatings, platinum-aluminide coatings, MCrAlY bond coats, and other such coatings or coating layers over the targeted surfaces. Furthermore, in certain cases, the turbomachine component may contain one and, perhaps, multiple blades or vanes (collectively referred to herein as "airfoils") desirably plated concurrently during the ionic liquid bath plating process. In the case of an insert-blade type rotor constructed from a number of discrete bladed pieces, for example, the ionic liquid bath plating may enable multiple discrete bladed pieces to be concurrently plated in separate cell vessels included within plating cell array 16 (FIG. 1). To further emphasize this point, an exemplary plating cell 12 within plating cell array 16, which is dimensionally tailored to accommodate such an insert-type rotor blade piece, will now be described in conjunction with FIG. 2.

Figure 2:
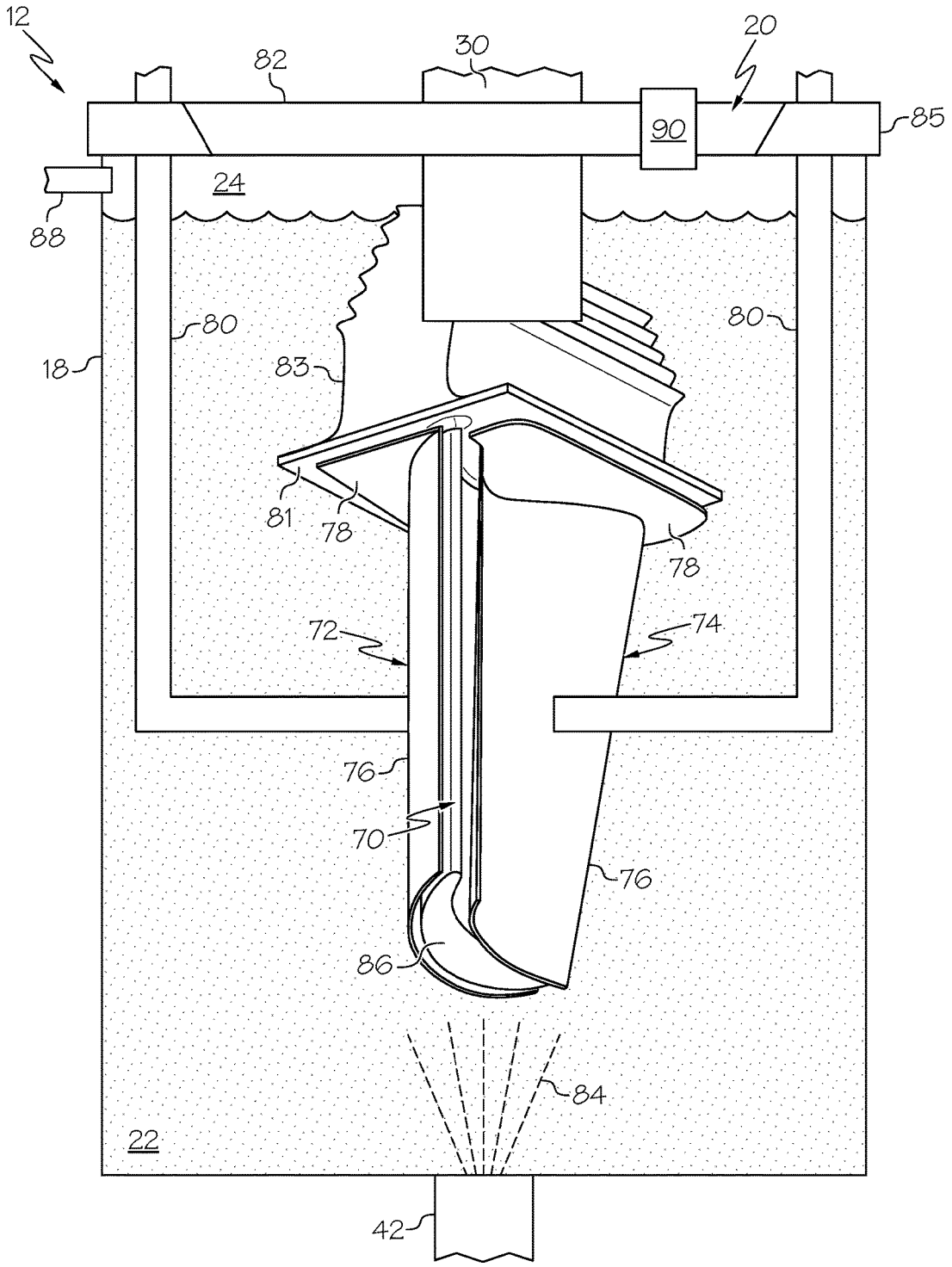
FIG. 2 is a simplified cross-sectional view of a cell vessel included in the gas-purged plating cell array of FIG. 1, as illustrated during the deposition of a metallic layer over an exemplary turbomachine component (here, a rotor blade piece) submerged within a plating solution bath retained or held within the illustrated cell vessel.

FIG. 2 is a more detailed schematic of a plating cell 12 containing a plating solution bath 22, a rotor blade piece 70, a first plating anode 72, and a second plating anode 74, as illustrated in accordance with an exemplary embodiment of the present disclosure and depicted during the ionic liquid bath plating process. As can be seen, plating anodes 72, 74 and rotor blade piece 70 are suspended in a close-proximity, non-contacting relationship within plating chamber 22, 24. Plating anodes 72, 74 and rotor blade piece 70 are submerged within plating solution bath 22, which fills the volumetric majority of plating chamber 22, 24 and underlies vessel headspace 24. Plating anodes 72, 74 can be consumable or non-consumable. In one embodiment, plating anodes 72, 74 are consumable aluminum anodes utilized to deposit an aluminum-containing metallic layer over selected surfaces of rotor blade piece 70. Constituents contained within plating solution bath 22 may also be co-deposited with aluminum onto surfaces of rotor blade piece 70 in at least some implementation. The composition of plating anodes 72, 74, plating solution bath 22, and the deposited plating layers may vary in further implementations.

Plating anodes 72, 74 are positioned on opposing sides of rotor blade piece 70 such that the blade of rotor blade piece 70 extends between anodes 72, 74. Plating anodes 72, 74 may be generally conformal with the geometry or topology of the surfaces of rotor blade piece 70 targeted for plating. In one embodiment, anodes 72, 74 are imparted with bodies 76 having three dimensionally contoured shapes, which generally follow or conform with the surface geometries of the pressure and suction sides of rotor blade piece 70. Additionally, each anode 72, 74 is produced to further include a lower base or skirt 78, which supports the deposition of a metallic plating layer over the platform area of rotor blade piece 70; that is, the relatively flat region 81 of piece 70 located between the rotor blade and the illustrated shank 83. Additional description of conformal anodes suitable for usage in ionic liquid bath plating metallic layers over rotor blades and other turbomachine components can be found in the following co-pending application, which is hereby incorporated by reference: U.S. application Ser. No. 15/139,033, entitled "METHODS AND ARTICLES RELATING TO IONIC LIQUID BATH PLATING OF ALUMINUM-CONTAINING LAYERS UTILIZING SHAPED CONSUMABLE ALUMINUM ANODES," and filed with the USPTO on Apr. 26, 2016.

Rotor blade piece 70 is suspended within plating solution bath 22 utilizing a cathode fixture or bracket 30. Similarly, anodes 72, 74 are maintained in their proper positions by anode brackets 80, which may or may not be integrally formed with the bodies of anodes 72, 74. In the illustrated embodiment, an upper portion of cathode bracket 30 and upper portions of anode brackets 80 extend through lid 20 for electrical coupling purposes. In other implementations, cathode bracket and/or anode brackets 80 may extend through a sidewall of cell vessel 18 for electrical coupling purposes.

Cathode bracket 30 and anode brackets 80 cooperate with cell vessel 18 and/or lid 20 to enable precise, close-proximity positioning of plating anodes 72, 74 and rotor blade piece 70, while further enabling plating chamber 22, 24 to be sealed from the ambient environment during the plating process. For example, as indicated in FIG. 2, lid 20 may have a removable central portion 82 through which cathode bracket 30 extends. Prior to plating, central lid portion 82 of lid 20 is withdrawn from plating cell vessel 12 along with cathode bracket 30 to enable attachment of rotor blade piece 70 to cathode bracket 30 outside of cell vessel 18. After rotor blade piece attachment to cathode bracket 30, central lid portion 82, rotor blade piece 70, and cathode brake 30 are then reinserted in a downward direction to partially or fully submerge piece 70 in plating solution bath 22. Central portion 82 of lid 20 registers or seats on outer peripheral portion 85 of lid 20 to ensure proper positioning of rotor blade piece 70 with respect to anodes 72, 74. Additionally, a gas-tight seal may be formed around the annular interface between lid sections or portions 82, 85, with non-illustrated gasketing or other sealing elements provided, as appropriate. By virtue of such a design, precise positioning between anodes 72, 74 and rotor blade piece 70 can be achieved on a highly repeatable basis, while ensuring that the interior of plating cell 12 is adequately sealed for gas purging and subsequent performance of the ionic liquid bath plating process.

With continued reference to FIG. 2, plating cell 12 can include various other components or features in addition to those previously described. Such additional features can include, for example, an inlet port 88 for the injection of purge gas by purge subsystem 60 (FIG. 1), as well as an exhaust or vent valve 90 for the outflow of moisture-containing air and other gas during purging. Plating cell 12 may also include at least one inlet 42 for delivering fresh plating solution to plating solution bath 22. Inlet 42 may imparted with a nozzle shape or other geometry to produce an impingement jet 84 when injecting plating solution flow into chamber 22, 24. Impingement jet 84 is usefully directed toward the region between anodes 72, 74 and rotor blade piece 70 to provide active flow adjacent the targeted plating regions along with any desired agitation. In the illustrated example in which rotor blade piece 70 is suspended within plating solution bath 22 in an inverted orientation, inlet 42 may be positioned proximate tip 86 of rotor blade piece 70 and configured to direct impingement jet 84 between anodes 86 and the opposing suction and pressure sides of piece 70. In further embodiments, additional inlets may be provided at other various locations in plating cell 12. Plating cell 12 can also include still further features, which are not shown in FIG. 2 for clarity. Such other features can include one or more outlets, which allow the outflow of plating solution from bath 22 for circulation through plating solution reservoir 38, as described above in conjunction with FIG. 1.

During the ionic liquid bath plating process, metallic layers are built-up or compiled over the targeted surfaces of rotor blade piece 70. After the metallic layers have been deposited to the their desired thicknesses, the ionic liquid bath plating process may conclude and rotor blade piece 70 may be removed from plating solution bath 22. Additional steps are subsequently performed to complete fabrication of rotor blade piece 70. For example, if an aluminide coating or platinum-aluminide coating is desirably formed over rotor blade piece 70, heat treatment may be carried-out to diffuse the coating precursor constituents into the superalloy parent material of piece 70. If the ionic liquid bath plating process is instead utilized to form a MCrAlY bond coat, additional steps may be carried-out to form an EBC or TBC over the newly-formed bond coat. Such additional steps may or may not include further iterations of the ionic liquid bath plating process. After completion of piece 70, rotor blade piece 70 may be attached to a hub disk (not shown) along with a number of like rotor blade pieces, and the resulting assembly may then be further processed (e.g., via machining, heat treatment, the formation of additional coatings, and so on) to complete fabrication of the insert-blade type GTE rotor.

Plating cell array 16 may contain any number of plating cells 12 similar or identical to that shown in FIG. 2 to concurrently plate several, if not all of the bladed pieces included in an insert-blade type GTE rotor. Due to the manner in which ionic liquid bath plating system 10 (FIG. 1) facilitates the precise positioning of the plating anodes with respect to the bladed pieces, and the active circulation of plating solution, such batch-processed bladed rotor pieces may plated on a highly consistent, efficient, and repeatedly basis. This notwithstanding, it may be desirable to concurrently or simultaneously plate multiple airfoils (e.g., blades or vanes) included in a single turbomachine component in further embodiments. In such embodiments, one or more multi-airfoil plating anode are advantageously utilized during the ionic liquid bath plating process. Such multi-airfoil plating anodes can be imparted with unique, fingered geometries, which are adapted to matingly conform with the multi-airfoil turbomachine component to be plated. Such an approach may be particularly useful in plating nozzle vanes of a turbine nozzle or the rotor blades of a bladed GTE rotor. Additional description in this regard will now be provided in conjunction with FIGS. 3-6.

Figure 3:
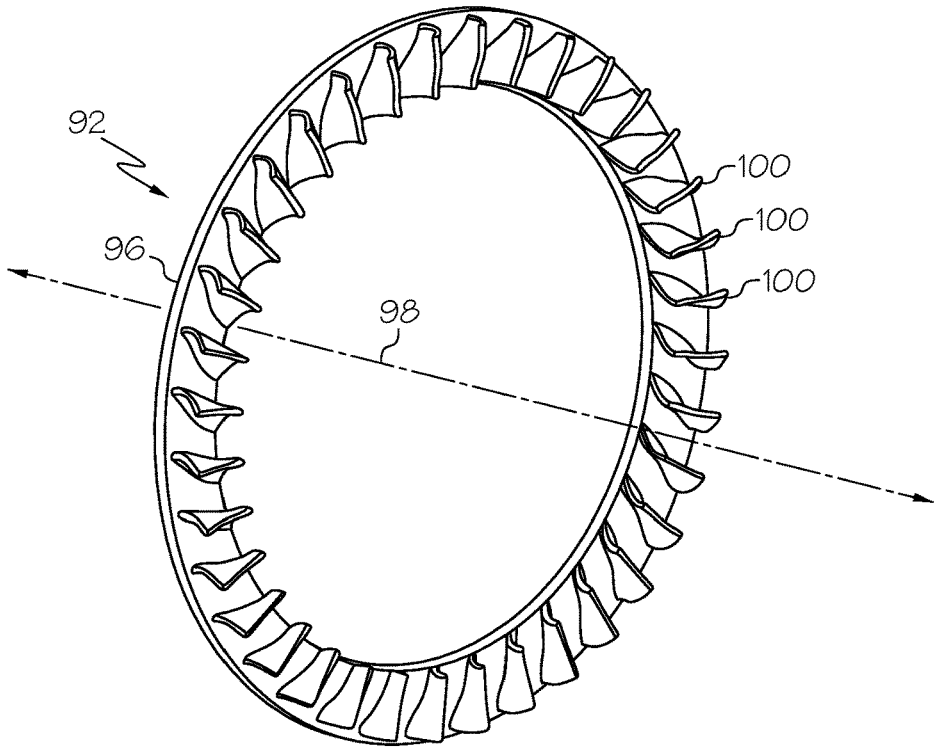
FIGS. 3 and 4 are isometric views of first and second multi-airfoil plating anodes, respectively, suitable for concurrently plating multiple airfoils contained in a single a turbomachine component, such as a bladed GTE rotor or turbine nozzle.
Figure 4:
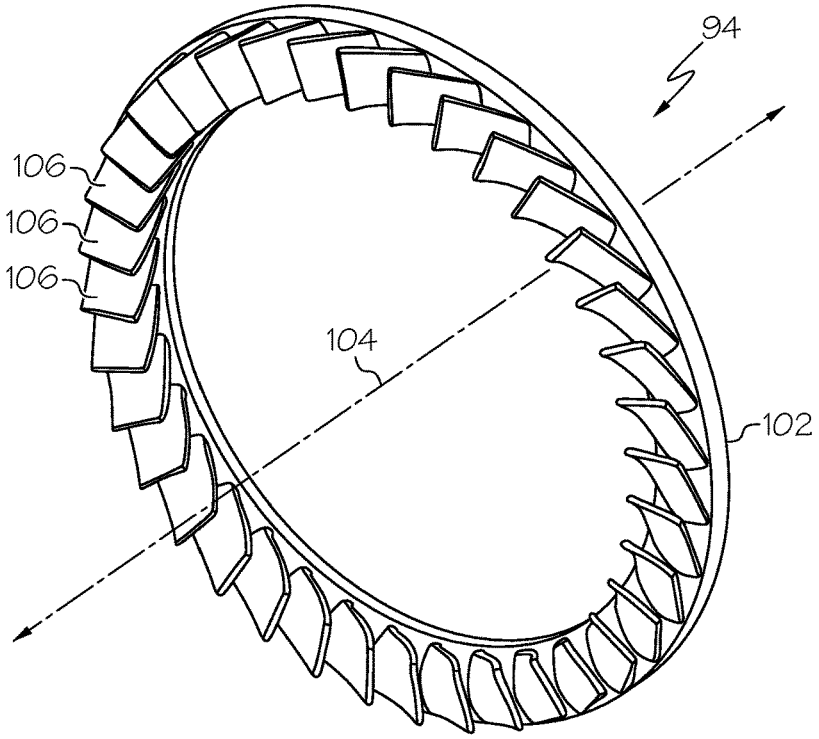

FIGS. 3 and 4 are isometric views of first and second multi-airfoil plating anodes 92, 94, respectively, as illustrated in accordance with a further exemplary embodiment of the present disclosure. Here, multi-airfoil plating anodes 92, 94 are similar, but not identical in design. Plating anodes 92, 94 are shaped to be matingly positioned on opposing sides of a multi-airfoil turbomachine component, such as a turbine nozzle or bladed GTE rotor, in a close proximity, mating relationship. Addressing first anode 92 (FIG. 3), multi-airfoil plating anode 92 includes an annular or ring-shaped anode body 96 through which a central opening is provided. A plurality of anode extensions or fingers 100 (only a few of which are labeled in FIG. 3) extend from anode body 96 along a longitudinal axis or centerline 98 of anode 92. Anode fingers 100 also twist or wrap gently about centerline 98 in a first direction such that each finger 100 has a curved geometry in three dimensions. In this particular example, anode fingers 100 are spatially distributed in an annular array and have an angular spacing, geometry, and dimensions permitting anode fingers 100 to be matingly interleaved or interspersed with the blades of a GTE rotor 108, as described more fully below in conjunction with FIGS. 5 and 6. In a similar regard, multi-airfoil plating anode 94 contains an annular anode body 102, which has a central opening and a centerline 104. A plurality of anode fingers 106 (again, only a few of which are labeled in FIG. 4) extend from anode body 102 and twist about centerline 104 in a second direction opposite the first direction.

Figure 5:
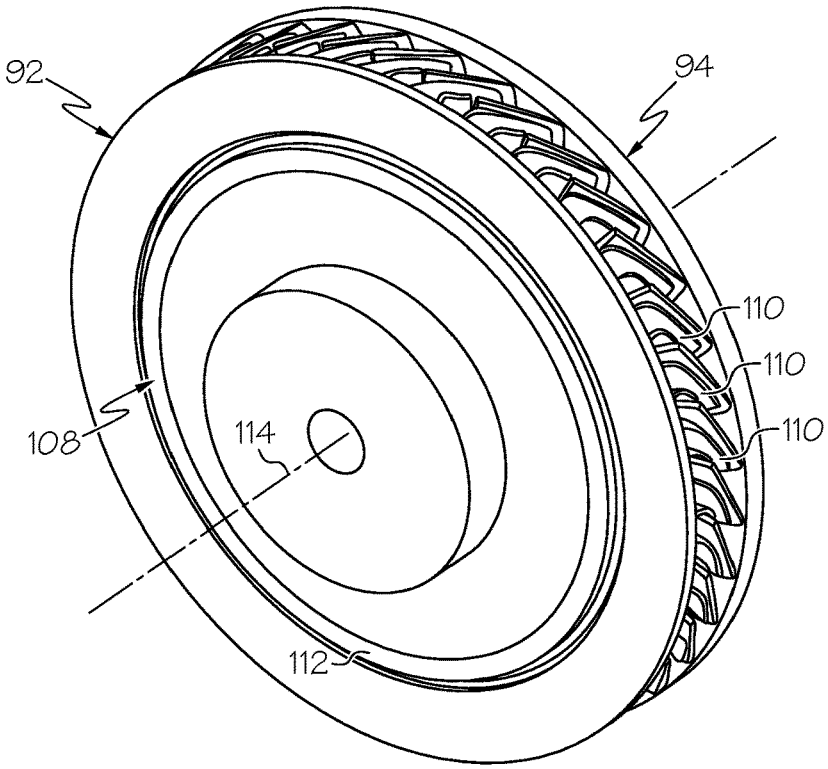
FIGS. 5 and 6 are isometric and detailed cutaway views, respectively, illustrating the first and second multi-airfoil plating anodes when positioned in a close proximity, non-contacting, mating relationship with a bladed GTE rotor, as illustrated accordance with a further exemplary embodiment of the present disclosure.
Figure 6:
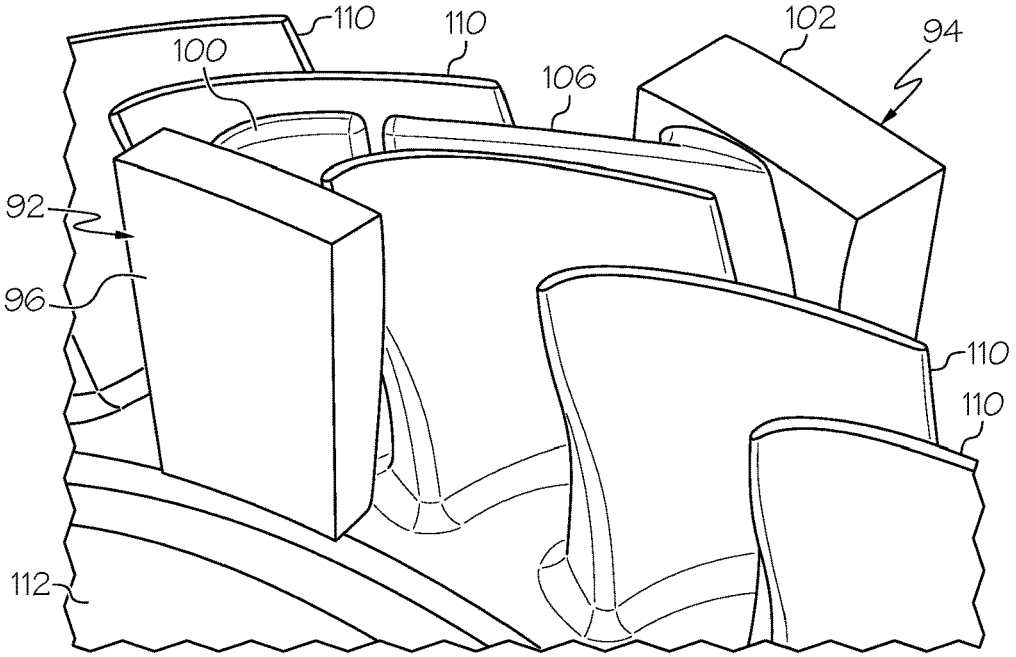

FIGS. 5 and 6 illustrate multi-airfoil plating anodes 92, 94 when positioned in a close-proximity, non-contacting, mating relationship with a multi-airfoil GTE component, which, in this specific example, assumes the form of a bladed GTE rotor 108. Generally stated, bladed GTE rotor 108 may correspond with workpiece 28 shown in FIG. 1, while either of plating anodes 92, 94 correspond with anode 34. As can be seen in FIGS. 5-6, bladed GTE rotor 108 includes a plurality of airfoils or blades 110, which extend from a rotor body or hub 112 in a radially outward direction. Blades 110 twist about the rotational axis or centerline of GTE rotor 108. As indicated above, fingers 100, 106 of plating anodes 92, 94 are numbered, sized, and shaped for mating insertion between blades 110. Accordingly, plating anode 92 and plating anode 94 may each contain the same number of fingers 100, 106, which is equivalent to the number of blades 110 contained in bladed GTE rotor 108 in an embodiment.

Prior to carrying-out ionic liquid bath plating process in earnest, multi-airfoil plating anodes 92, 94 are positioned on opposing sides of GTE rotor 108, as generally shown in FIG. 5. Again, each plating anode 92, 94 is positioned with respect to bladed GTE rotor 108 such that its anode fingers 100, 106 are received between blades 110 of GTE rotor 108 in a close proximity, non-contacting relationship. This may be most readily observed in FIG. 6, noting that only relatively limited portions of plating anodes 92, 94 are shown to more clearly illustrate the manner in which anode fingers 100, 106 are received within the void or valley regions formed between neighboring pairs of rotor blades 110. In embodiments, anode fingers 100, 106 may occupy at least a volumetric majority of the space between rotor blades 110 when plating anodes 92, 94 are properly positioned with respect to bladed GTE rotor 108. Additionally, when positioned as shown in FIGS. 5-6, anode fingers 100, 106 may extend toward one another and may or may not physically contact, as taken along the rotational axis of GTE rotor 108 (corresponding to dashed line 114 in FIG. 5).

As rotor blades 110 twist about the centerline or rotational axis of bladed GTE rotor 108, so too do anode fingers 100, 106 twist about their respective anode centerlines 98, 104 in a similar fashion. Accordingly, during positioning of anodes 92, 94 relative to GTE rotor 108, multi-airfoil plating anodes 92, 94 may be positioned adjacent bladed GTE rotor 108 by moving or sliding anodes 92, 94 relative to rotor 108 linearly along an insertion axis 114, which may be substantially coaxial with the component centerline and/or with the anode centerlines 98, 104 (FIGS. 3-4). At the same time, multi-airfoil plating anodes 92, 94 may be rotated relative to bladed GTE rotor 108 about insertion axis 114 in a manner avoiding contact or rubbing between anode fingers 100, 106 and rotor blades 110. As anode fingers 100, 106 twist or turn in different rotational directions, multi-airfoil plating anodes 92, 94 may be rotated in opposing directions during the positioning process. Non-illustrated cathode and anode brackets or fixtures may then be utilized to maintain plating anodes 92, 94 and bladed GTE rotor 108 in the spatial relationship shown in FIGS. 5-6. After multi-airfoil plating anodes 92, 94 are properly positioned with respect to bladed GTE rotor 108, the ionic liquid bath plating process may be carried-out by applying an appropriate electrical potential between the plating anodes 92, 94 and GTE rotor 108 to deposit metallic layers over rotor blades 110 and, perhaps, other non-masked regions of GTE rotor 108 in the previously-described manner. In further embodiments, a different number of multi-airfoil plating anodes may be utilized to concurrently deposit plated layers over multiple airfoils included within bladed GTE rotor 108 or a different type of multi-airfoil GTE component; e.g., in a further implementation, plating may be carried-out utilizing a single multi-airfoil plating anode, which has anode fingers lengthened as compared to anode fingers 100, 106.

CONCLUSION

The foregoing has thus provided embodiments of enhanced ionic liquid bath plating systems, which overcome various limitations associated with conventional ionic liquid bath plating systems. In embodiments, the ionic liquid bath plating system includes a number of relatively small, low volume modular tanks or plating cells, which are spatially distributed in a gas-purged plating cell array. When the ionic liquid bath plating system is filled with a selected non-aqueous plating solution, the plating cells retain or hold individual plating solution baths. Cumulatively, the plating solutions baths may have a reduced surface area as compared to a conventional large, open bath plating setup; and, therefore, may be more readily and thoroughly sealed from contamination by contact with moisture-laden ambient air as compared to such an open bath plating setup. Additionally, relative to such open bath plating setups, the reduced volume plating cells may accessed more easily by personnel to facilitate the precise placement of components or workpieces and the plating anodes in the individual plating solution baths. Manual access may be further facilitated by locating bulky items, such as pumps, heaters, filters, and the like, away from the primary work area and relocating such items in the reservoir tank. The compartmentalized, multi-cell plating setup enables plating anodes to remain active in a small amount of bath solution, while other anodes can be removed and re-inserted without requiring system shutdown for increased process efficiency. Finally, as multiple plating cells are supplied with fresh plating solution from a common reservoir, new plating cells can be introduced into the plating cell array with only limited increases in total bath volume to provide a high level flexibility, while minimizing material (plating solution) costs.

In certain implementations, the above-described ionic liquid bath plating system includes a gas-purged plating cell array containing cell vessels having upper vessel openings, lids positionable over the upper vessel openings to sealingly enclose the cell vessels, and plating chambers containing plating solution baths and vessel headspaces when the ionic liquid bath plating system is filled with a non-aqueous plating solution. The plating system further includes a gas-purged reservoir tank, which retains or holds a plating solution reservoir when the ionic liquid bath plating system is filled with the non-aqueous plating solution. A flow circuit fluidly couples the gas-purged reservoir tank to the gas-purged plating cell array in a manner enabling the exchange of the non-aqueous plating solution between the plating solution reservoir and the plating solution baths during operation of the ionic liquid bath plating system. In certain embodiments, the cell vessels contained in the gas-purged plating cell array each have a volumetric capacity for non-aqueous plating solution less that of the gas-purged reservoir tank. Additionally or alternatively, the plating system may further contain a vessel purge subsystem, which is fluidly coupled to the gas-purged plating cell array which is configured to selectively direct a first purge gas into the cell vessels to expel moisture-containing air from the vessel headspaces. The first purge gas is usefully injected into the vessel headspaces in an ultradry state containing less than 0.1% moisture, by volume.

In further embodiments, the above-described ionic liquid bath plating system may also include a reservoir tank headspace, which is purged with a second purge gas different than the first purge gas. In such embodiments, a gas trap fluidly may be coupled between the gas-purged plating cell array and the gas-purged reservoir tank to deter flow of the first purge gas (e.g., an argon-based gas) into the reservoir tank headspace purged with the second purge gas (e.g., a nitrogen-based gas). In still other embodiments, the cell vessels may be adapted to receive rotor blade pieces having opposing suction and pressure sides, and the ionic liquid bath plating system may include a plurality of plating anode pairs, with each plating anode pair located in a different one of the cell vessels. In such embodiments, each plating anode pair can include: (i) a first plating anode sized and shaped to be positioned adjacent the pressure side of one of the rotor blade pieces in a close-proximity, non-contacting, generally conformal relationship; and (ii) a second plating anode sized and shaped to be positioned adjacent the suction side of one of the rotor blade pieces in a close-proximity, non-contacting, generally conformal relationship. In yet further implementations, the ionic liquid bath plating system may contain a multi-airfoil plating anode configured to be positioned within one of the cell vessels. In such implementations, the multi-airfoil plating anode may include multiple anode fingers, which extend from the anode body and which twist about a centerline of the anode body or plating anode.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as setforth in the appended Claims.

What is claimed is:

1. A method carried-out utilizing an ionic liquid bath plating system including a plurality of cell vessels fluidly coupled to a gas-purged reservoir tank having a headspace, the method comprising:

placing workpieces in the plurality of cell vessels such that the workpieces are at least partially submerged in plating solution baths, which are retained within the cell vessels when the ionic liquid bath plating system is filled with a selected non-aqueous plating solution;

positioning plating anodes adjacent the workpieces in the plating solution baths;

after positioning the plating anodes adjacent the workpieces, enclosing the plurality of cell vessels with lids such that the plurality of cell vessels contain vessel headspaces above the plating solution baths;

after enclosing the plurality of cell vessels with lids, injecting a first purge gas into the plurality of cell vessels to purge the vessel headspaces;

energizing the workpieces and the plating anodes to deposit metallic layers on selected surfaces of the workpieces utilizing an ionic liquid bath plating process; and purging the headspace of the gas-purged reservoir tank with a second purge gas different than the first purge gas.

2. The method of claim 1 further comprising circulating non-aqueous plating solution between the plating solution baths and the plating solution reservoir during the ionic liquid bath plating process.

3. The ionic liquid bath plating system of claim 2 further comprising conditioning the plating solution reservoir utilizing an electrolytic dummy cell having terminals in contact with the plating solution reservoir during the ionic liquid bath plating process.

4. The method of claim 1 further comprising selecting the first and second purge gasses to comprise an argon-based gas and a nitrogen-based gas, respectively.

5. The method of claim 1 wherein injecting comprises injecting, as the first purge gas, an argon-based gas into the plurality of cell vessels to create blankets of the argon-based gas overlying the plating solution baths retained within the plurality of cell vessels.

6. The method of claim 1 wherein injecting comprises delivering the first purge gas into the vessel headspaces in an ultradry state containing less than 0.1% moisture, by volume.

7. The method of claim 1 wherein placing comprises placing a plurality of rotor blade pieces in the plurality of cell vessels, the plurality of rotor blade pieces each having opposing suction and pressure sides; and wherein energizing comprises energizing the plurality of rotor blade pieces and the plating anodes to concurrently deposit metallic layers over at least the suction and pressure sides of the plurality of rotor blade pieces during the ionic liquid bath plating process.

8. The method of claim 1 wherein at least one the workpieces comprises a turbomachine component including multiple airfoils;

wherein the plating anodes comprise a multi-airfoil plating anode from which multiple anode fingers extend; and wherein positioning comprises positioning the multi-airfoil plating anode adjacent the turbomachine component such that the multiple anode fingers extend between the multiple airfoils.

9. The method of claim 8 wherein the multiple airfoils included within the turbomachine component are arranged in an annular array; and wherein the method further comprises selecting the multi-airfoil plating anode to include an annular array of the multiple anode fingers, which extends between the annular array of the multiple airfoils when the multi-airfoil plating anode is positioned adjacent the turbomachine component.

10. A method carried-out utilizing an ionic liquid bath plating system including a cell vessel fluidly coupled to a gas-purged reservoir tank having a headspace, the method comprising:

placing a workpiece in the cell vessel such that the workpiece is at least partially submerged in a plating solution bath, which is retained within the cell vessel when the ionic liquid bath plating system is filled with a selected non-aqueous plating solution;

positioning a plating anode adjacent the workpiece in the plating solution bath;

after positioning the plating anode adjacent the workpiece, enclosing the cell vessel with a lid such that the cell vessel contains a vessel headspace above the plating solution bath;

after enclosing the cell vessel with the lid, injecting a first purge gas into the cell vessel to purge the vessel headspace;

energizing the workpiece and the plating anode to deposit a metallic layer on selected surfaces of the workpieces utilizing an ionic liquid bath plating process; and purging the headspace of the gas-purged reservoir tank with a second purge gas different than the first purge gas.

11. The method of claim 10 further comprising circulating non-aqueous plating solution between the plating solution bath and the plating solution reservoir during the ionic liquid bath plating process.

12. The method of claim 11 further comprising conditioning the plating solution reservoir utilizing an electrolytic dummy cell having terminals in contact with the plating solution reservoir during the ionic liquid bath plating process.

13. The method of claim 10 further comprising selecting the first and second purge gasses to comprise an argon-based gas and a nitrogen-based gas, respectively.

14. The method of claim 10 wherein injecting comprises injecting, as the first purge gas, an argon-based gas into the cell vessel to create a blanket of the argon-based gas overlying the plating solution bath retained within the cell vessel.

15. The method of claim 10 wherein injecting comprises delivering the first purge gas into the vessel headspace in an ultradry state containing less than 0.1% moisture, by volume.

16. The method of claim 10 wherein placing comprises placing a rotor blade piece in the cell vessel, the rotor blade piece having opposing suction and pressure sides; and wherein energizing comprises energizing the rotor blade piece and the plating anode to concurrently deposit the metallic layer over at least the suction and pressure sides of the rotor blade piece during the ionic liquid bath plating process.

17. The method of claim 10 wherein the workpiece comprises a turbomachine component including multiple airfoils;

wherein the plating anode comprises a multi-airfoil plating anode from which multiple anode fingers extend; and wherein positioning comprises positioning the multi-airfoil plating anode adjacent the turbomachine component such that the multiple anode fingers extend between the multiple airfoils.

18. The method of claim 17 wherein the multiple airfoils included within the turbomachine component are arranged in an annular array; and wherein the method further comprises selecting the multi-airfoil plating anode to include an annular array of the multiple anode fingers, which extend between the annular array of the multiple airfoils when the multi-airfoil plating anode is positioned adjacent the turbomachine component.

* * * * *